US005517780A

United States Patent [19]

Haber et al.

[11] Patent Number: 5,517,780

[45] Date of Patent: May 21, 1996

[54] AUTOMATICALLY DISABLED FIREARM

[75] Inventors: Terry M. Haber, Lake Forest; William H. Smedley, Lake Elsinore; Clark B. Foster, Laguna Niguel, all of Calif.

[73] Assignee: Habley Medical Technology Corporation, Lake Forest, Calif.

[21] Appl. No.: 160,506

[22] Filed: Dec. 1, 1993

[51] Int. Cl.[6] ..... F41A 17/28

[52] U.S. Cl. ..... 42/70.08; 42/70.01

[58] Field of Search ..... 42/70.08, 70.04, 42/70.05, 70.01; 89/148, 154

[56] References Cited

U.S. PATENT DOCUMENTS

| | | | |
|---|---|---|---|
| 944,606 | 12/1909 | Frommer | 89/148 |
| 1,484,671 | 2/1924 | Pomeroy | 42/70.04 |
| 2,182,693 | 12/1939 | Harton | 42/70.01 |
| 4,208,947 | 6/1980 | Hillberg | 89/148 |
| 4,763,431 | 8/1988 | Allan et al. | 42/70.08 |
| 4,791,747 | 12/1988 | Pastor | 42/66 |

FOREIGN PATENT DOCUMENTS

| | | | |
|---|---|---|---|
| 16358 | 5/1904 | Australia | 42/70.08 |
| 600765 | 2/1926 | France | 42/70.01 |
| 18702 | of 1901 | United Kingdom | 42/70.08 |
| 18973 | of 1901 | United Kingdom | 42/70.01 |

*Primary Examiner*—Stephen M. Johnson
*Attorney, Agent, or Firm*—Townsend and Townsend and Crew

[57] ABSTRACT

An improved automatically disabled handgun (2) is of the type having a handle assembly (10) extending from a barrel/receiver assembly (8), the handgun normally carried in a holster (150). One or more switches (190; 144, 82) are depressed by the user grasping the handle to enable the handgun to be fired. Release of the handgun, such as by dropping the handgun, releases the switch(es) to automatically temporarily disable the handgun.

13 Claims, 10 Drawing Sheets

AUTOMATICALLY DISABLED FIREARM

BACKGROUND OF THE INVENTION

Virtually all law enforcement officers are armed with handguns, normally carried within holsters when not needed. Under appropriate circumstances the officer may draw the handgun from the holster. One of the problems with doing so is that the officer may lose control of the handgun during a scuffle or fight with a criminal. This creates a situation in which the officer's own weapon could be used against the officer. This same problem can also arise with other types of firearms, such as rifles and shotguns.

SUMMARY OF THE INVENTION

The present invention is directed to an improvement in firearms, especially handguns, by which the handgun or other firearm is effectively automatically disabled once the handgun has been removed from the officer's, or other user's, holster and then dropped or otherwise released by the officer.

The improved automatically disabled firearm is of the type having a handle assembly or other handgrip extending from or otherwise associated with a barrel/receiver assembly. The invention broadly relates to the enablement of the firearm by the user pressing on or otherwise manipulating one or more switches, coupled to the firing mechanism, when grasping the handgrip. The switches are biased so that once the firearm is released, such as by being dropped, the switches are automatically biased back to their pre-manipulated, disabled positions. Thus, the firearm can be fired only when the one or more switches are in their enabled positions, since when the switches are in their disabled positions, the switches prevent the firing mechanism from discharging the weapon. The one or more switches are designed so that the need for actuation of the switches is not self-evident to the casual observer.

In one embodiment, a first switch is mounted to the body, typically along one side of the handle near the upper end of the handle, and movable from a first position to a second position. The first switch is biased towards the first position. A second switch, typically mounted to the forward edge of the handle, is movable between a disabled position and an enabled position. The second switch is biased towards the disabled position.

The second switch is coupled to the firing mechanism so to prevent firing of the handgun when the second switch is in the disabled position. The first and second switches are interconnected so that the second switch cannot be moved to the enabled position unless the first switch is in the second position. The switches are constructed so that the biasing elements automatically bias the switches to the first and disabled positions when the first and second switches are released, such as when the handgun is dropped, so to disable the handgun.

A primary aspect of this first embodiment of the invention is the recognition that the act of drawing the weapon from the holster can provide the officer with the ability to simultaneously manipulate first and second arming switches on the handgun with only one hand while that same action, after the handgun has been removed from the holster, would typically require two hands and a knowledge of the arming system. Thus, with the present invention, if the handgun is dropped by the officer and picked up by a criminal, the handgun is not immediately useable by the criminal. The first and second switches must both be pressed; pressing the first switch typically requires an upward movement (that is, along the handle and towards the receiver) by the user's thumb against the first switch. The force required to deflect the first switch is sufficiently great, preferably about 3 to 6 pounds (1.3 to 2.7 kg), so that for most people this actuation of the first switch requires that the force applied by the user against the first switch be counteracted by the weapon pressing against another object, such as by the holster when in the holster or by the user's other hand when outside the holster. A user's unfamiliarity with the need for the actuation of the arming switches and the typical need to use two hands to do so (when outside the holster) can provide the officer with sufficient time to disarm the criminal or otherwise prevent the criminal from using the officer's own weapon against the officer.

A second embodiment of the invention used an enable switch mounted to the body, typically along one side of the handle. The switch is typically positioned for engagement by the user's thumb. This switch, part of an enable switch assembly, is used to prevent firing of the weapon unless the switch is actuated, typically depressed, by the user. The switch is, however, preferably concealed under an elastomeric cover covering the handle so that the location of the switch is not readily apparent in case one other than the owner of the weapon obtains access to the weapon. The enable switch is preferably designed so that the location of the switch can be adjusted to suit the personal characteristics of the user's hand.

This second embodiment of the invention has the advantage of only requiring a single switch manipulation by the user to enable the weapon. In the disclosed embodiment the switch assembly is designed so that it can engage the hammer draw bar when the hammer draw bar is in either of two stable positions. When so engaged, the draw bar cannot move sufficiently to fire the weapon. The two stable positions are typically when the hammer is fully forward and when the hammer is pulled part way back, such as occurs after firing a semi-automatic pistol.

A primary aspect of this second embodiment of the invention is the recognition and appreciation that the need to depress a switch which is normally hidden and is not readily observable to enable the weapon can provide a significant level of protection in the event an officer drops or otherwise loses control of a handgun. Also, the ability to position the switch to accommodate the particular user helps to ensure that a different person, picking up the weapon, will not inadvertently actuate the enable switch to enable the weapon. Since only the owner of the weapon, or other law enforcement personnel, would likely be familiar with the need for actuation of the arming switch, this requirement can provide the officer with sufficient time to take appropriate action once control of the officer's weapon has been lost.

Other features and advantages of the invention will appear from the following description in which the preferred embodiments have been set forth in detail in conjunction with the accompanying drawings.

DESCRIPTION OF THE PREFERRED EMBODIMENT

Figure 1:
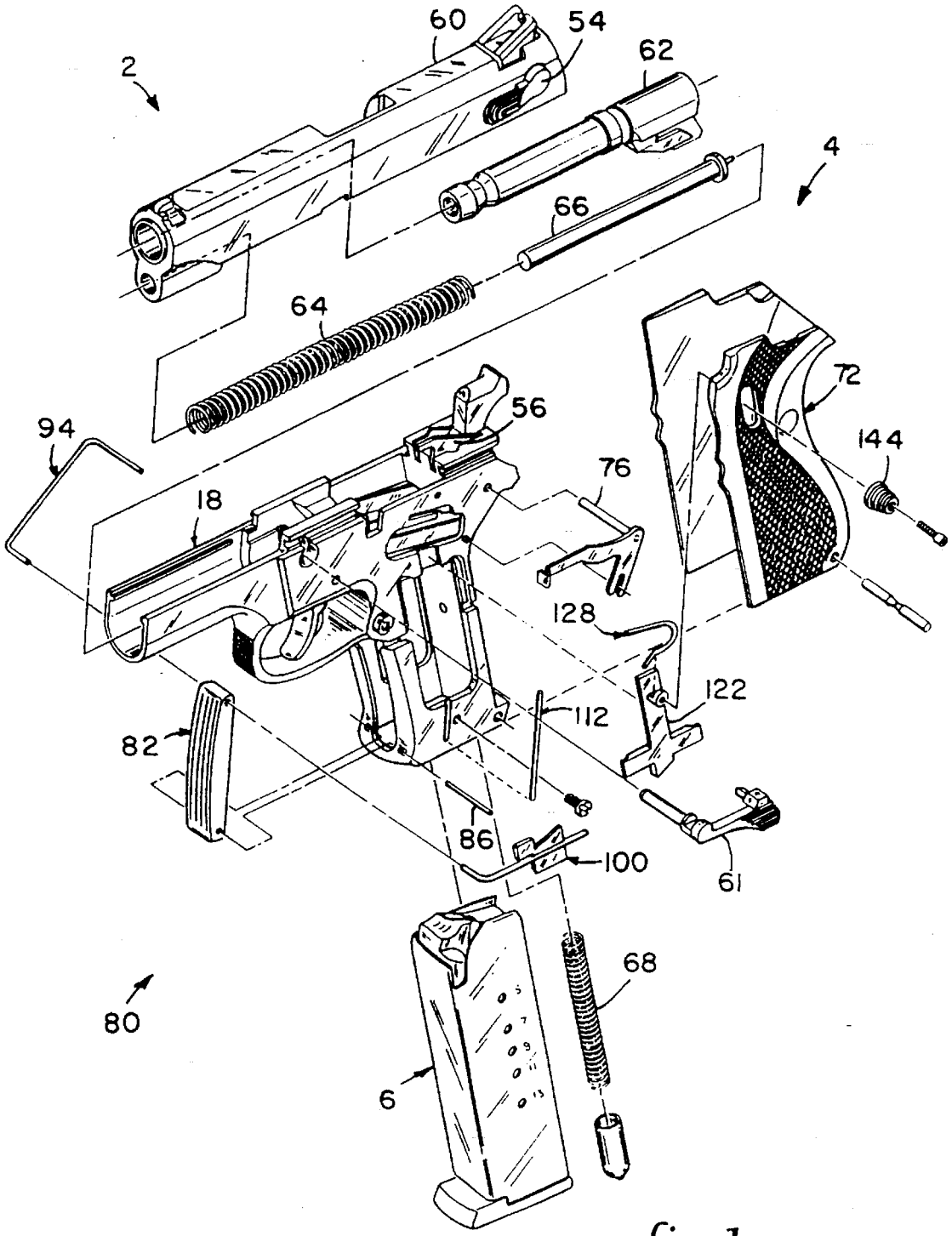
FIG. 1 is an exploded isometric view of a handgun made according to the invention.
Figure 2:
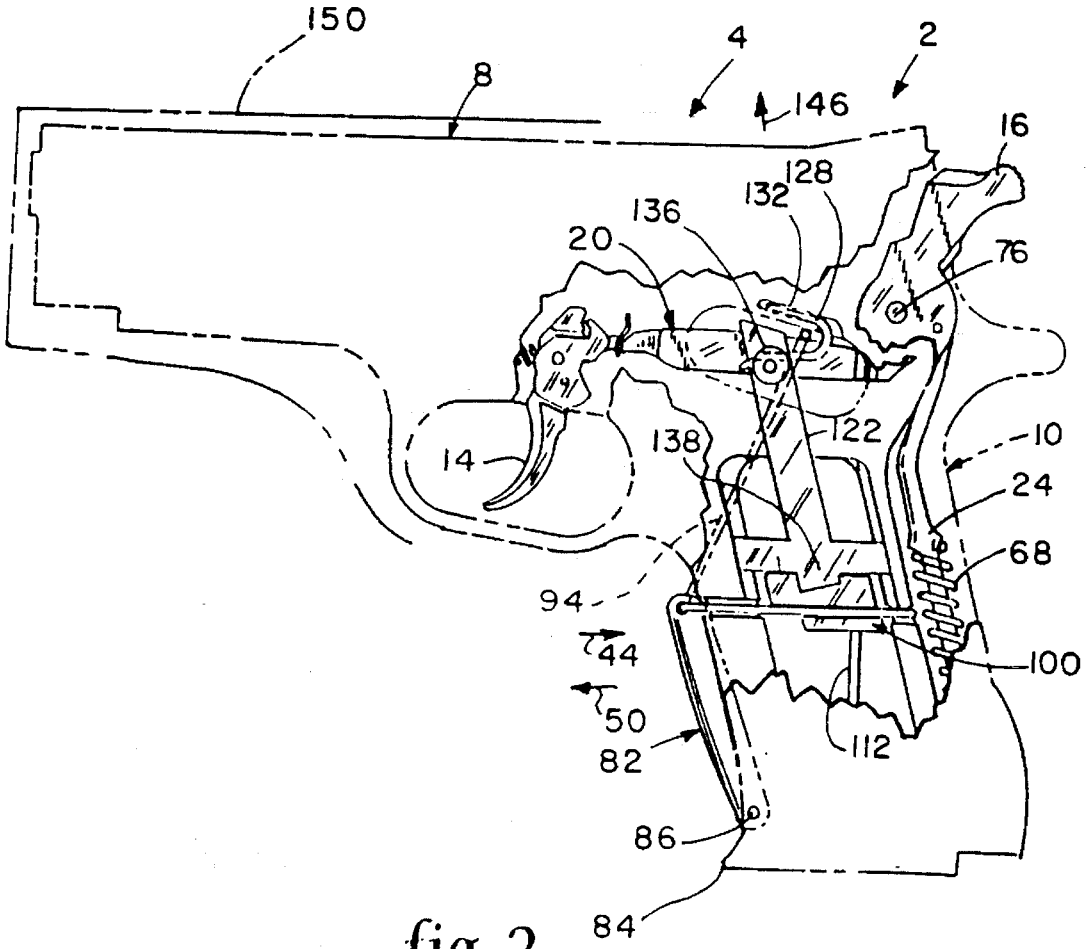
FIG. 2 is a side view of the handgun of FIG. 1 illustrating the firing mechanism and the firing mechanism disabling components in a safety-on or disabled condition with the remainder of the handgun and a holster shown only in outline form.

FIGS. 1–2 illustrate a handgun 2 at various states of assembly. Handgun 2 is, in its preferred embodiment, a Smith and Wesson 9 mm model 5904 modified according to the present invention. Since many of the parts of this weapon are well known, they will not be described in detail. Rather, the primary descriptions will be with regard to the improvements made to this weapon which permit it to be automatically disabled once armed and then released, such as by being dropped, by the user.

Broadly, handgun 2 includes a body 4 and a magazine or clip 6. Body 4 includes broadly a barrel/receiver assembly 8 and a handle assembly 10 extending from assembly 8. Barrel/receiver assembly 8 includes a firing mechanism 12 shown best in FIGS. 3A–3C. Firing mechanism 12 includes a trigger 14, a hammer 16, both pivotally mounted to a unitary case 18 shown best in FIG. 1, and a hammer draw bar 20 coupling trigger 14 and hammer 16. Hammer 16 is biased forward, that is in the direction of arrow 22, by a stirrup spring assembly 24.

Draw bar 20 has a cut-out 26 within which an extension 28 of trigger 14 is situated. Extension 28 has a tip 30 which engages and bears against a concave region 32 formed in the distal end 34 of draw bar 20. Draw bar 20 is biased in the direction of arrow 36 in FIG. 3A by a trigger spring 38. That is, trigger spring 38 biases draw bar 20 both rearwardly and upwardly so that the proximal end 40 of draw bar 20 is normally biased against the serrated or notched engagement surface 42 of hammer 16. The proximal movement, that is in the direction of arrow 44, is limited by the engagement of a hook portion 46 at distal end 34 of draw bar 20 with the pivot pin 48 to which trigger 14 is pivotally mounted. This is best seen by comparing FIGS. 3A and 3B.

Figure 3A:
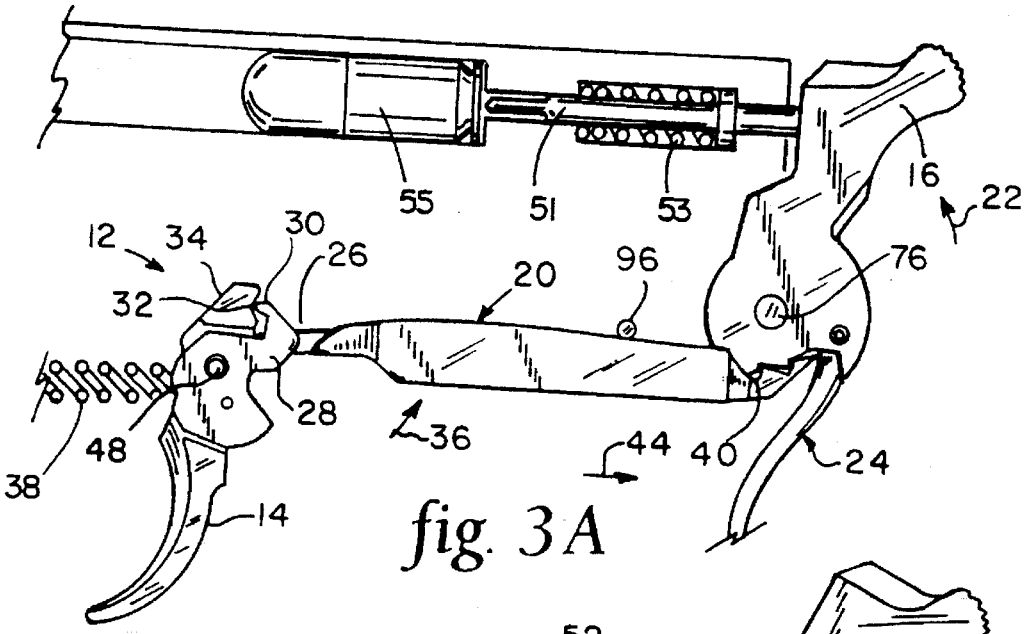
FIG. 3A is an enlarged side view of the firing mechanism of FIGS. 1–2, shown in conjunction with a firing pin and cartridge, with the hammer and trigger both in their forward or distal positions and in a safety-off or enabled condition.
Figure 3B:
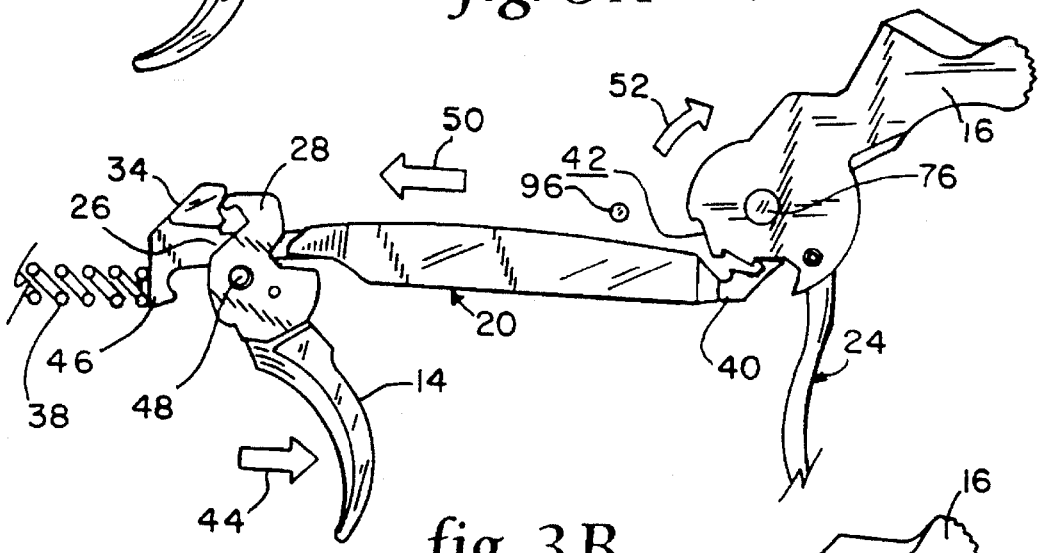
FIG. 3B is similar to FIG. 3A but showing the trigger pulled almost all the way back, causing the hammer draw bar to pivot the hammer in the direction of arrow 52 against the bias of the hammer drive spring just before the hammer draw bar is released from the hammer, which will allow the hammer to rotate forward to the hammer-forward position of FIG. 3A.

Pulling on trigger 14, indicated by arrow 44 of FIG. 3B, causes draw bar 20 to move generally distally in the direction of arrow 50 as shown in FIG. 3B. The engagement of proximal end 40 of draw bar 20 with notched engagement surface 42 of hammer 16 causes the hammer to pivot in the direction of arrow 52 against the bias of stirrup spring assembly 24. Continued movement of trigger 14 in the direction of arrow 44 will cause the disengagement of proximal end 40 and surface 42, thus allowing stirrup spring assembly 24 to rotate hammer 16 in the direction of arrow 22, thus allowing hammer 16 to contact firing pin 51 (shown only in FIG. 3A) to drive the firing pin against the bias of a firing pin spring 53 and against cartridge 55 to fire the weapon.

Figure 1A:
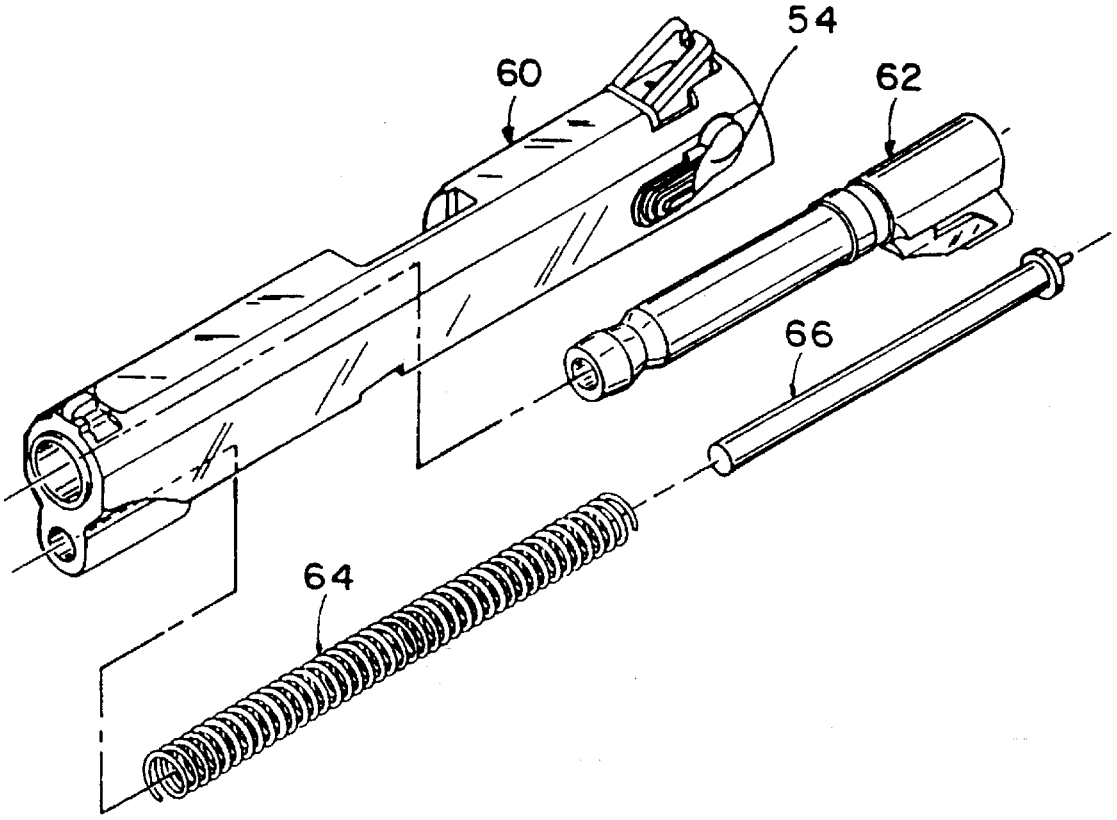
FIGS. 1A–1D are views of groups of parts of the handgun of FIG. 1 enlarged to show detail.
Figure 3C:
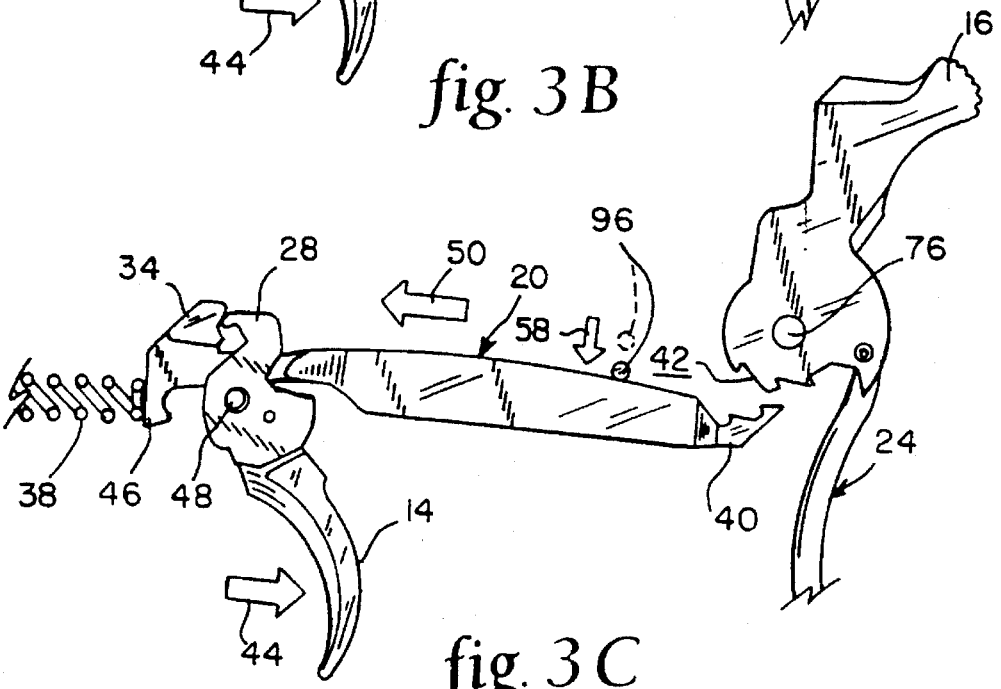
FIG. 3C illustrates the firing mechanism in the safety-on or disabled condition as a result of releasing the actuation bar of FIG. 2, causing the wire form to pivot the hammer draw bar downwardly, so that movement of the trigger rearwardly to the same position of FIG. 3B results in no movement of the hammer.
Figure 4:
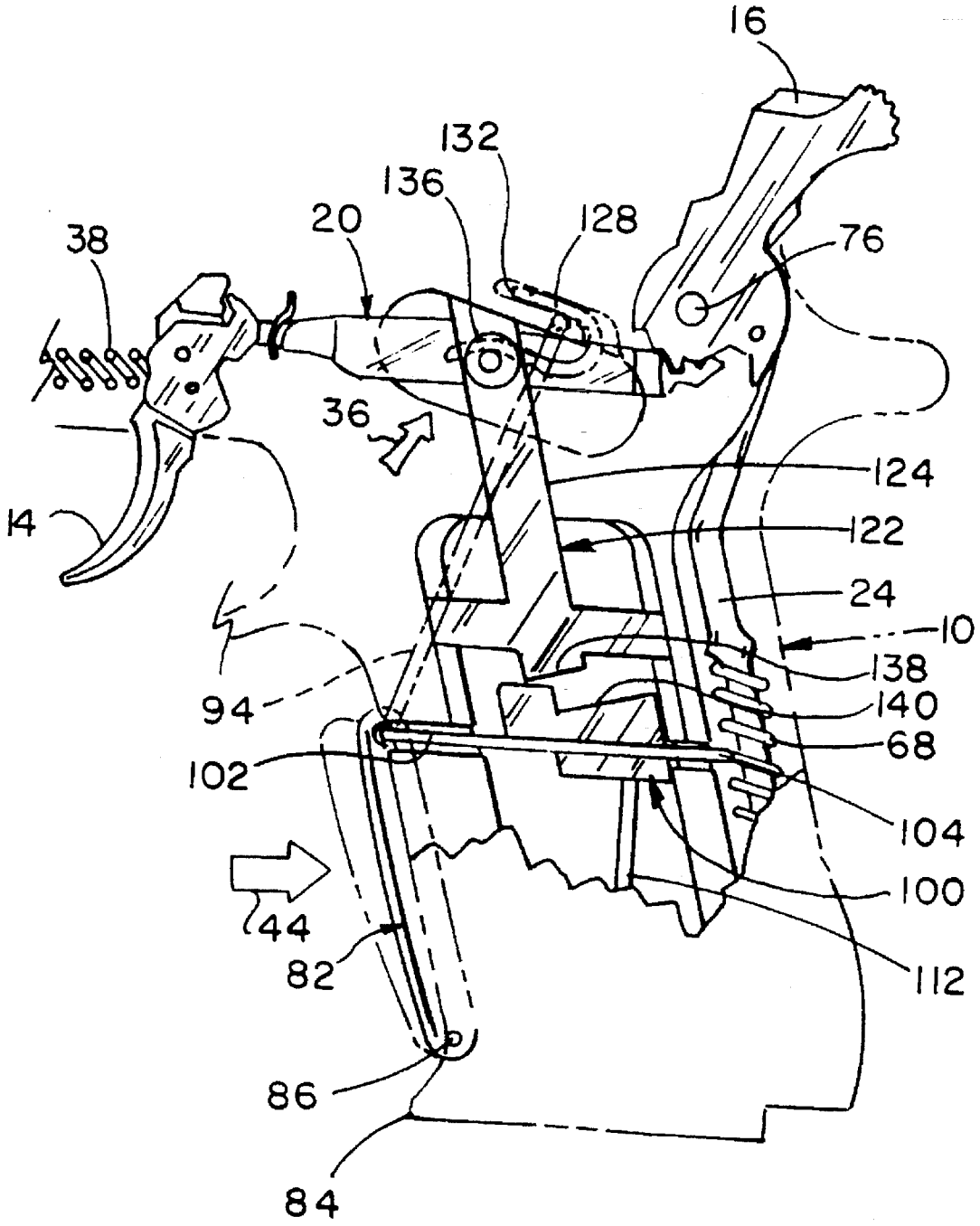
FIG. 4 is an enlarged view of a portion of the components of FIG. 2 after the first and second switches have been pushed to place the weapon in a safety-off or enabled condition.

The above-described structure and functions are all generally conventional. The present invention interacts with firing mechanism 12 in the same manner as actuation of safety 54 shown in FIGS. 1 and 1A. That is, to disable handgun 2 in a conventional manner, safety 54 is rotated downwardly by the user. This cams lever 56 which drives draw bar 20 in the direction of arrow 58 as indicated in FIG. 3C. Doing so causes draw bar 20 to become disengaged from hammer 16 so that pulling on trigger 14 does nothing with regard to the hammer so that the weapon does not fire. Although disabling the weapon in the present invention could be done any number of ways, such as by interfering with the movement of hammer 16 or trigger 14, in the preferred embodiment the disabling function is accomplished the same way as accomplished by safety 54, that is by driving hammer draw bar 20 downwardly so to disengage from hammer 16.

Figure 1B:
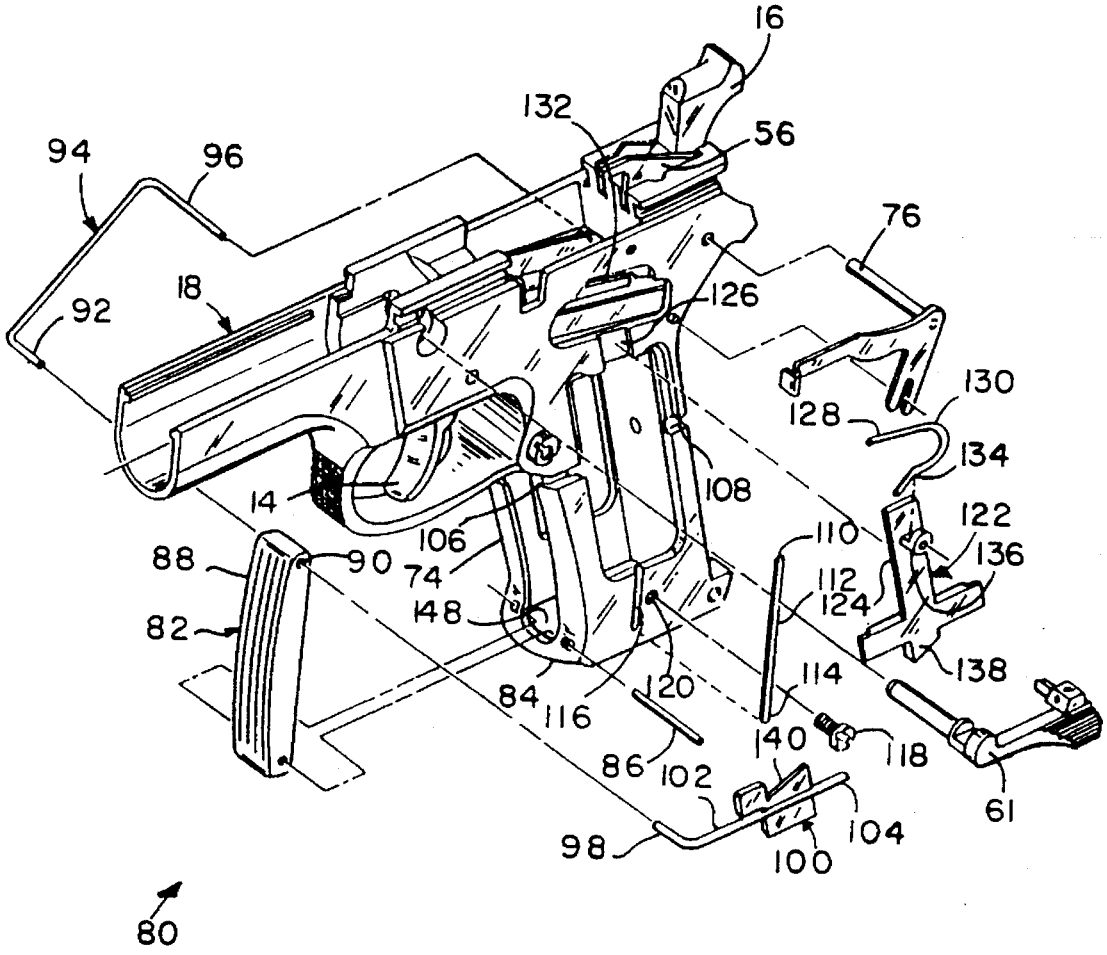
Figure 1C:
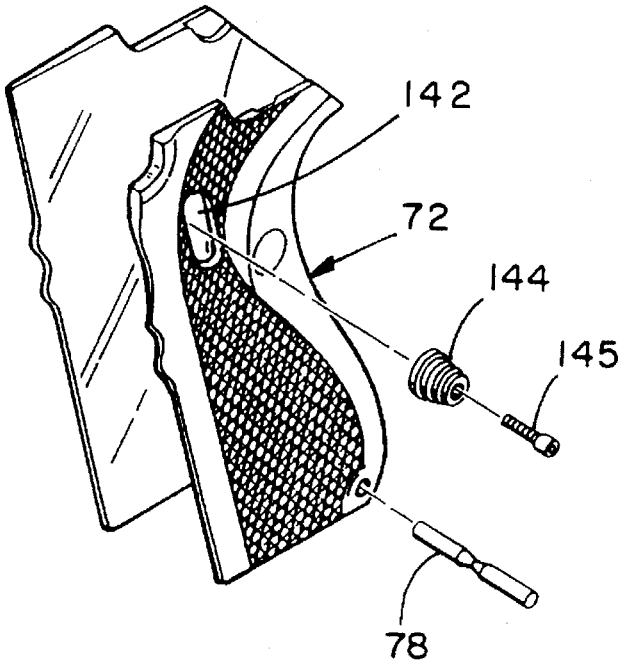
Figure 1D:
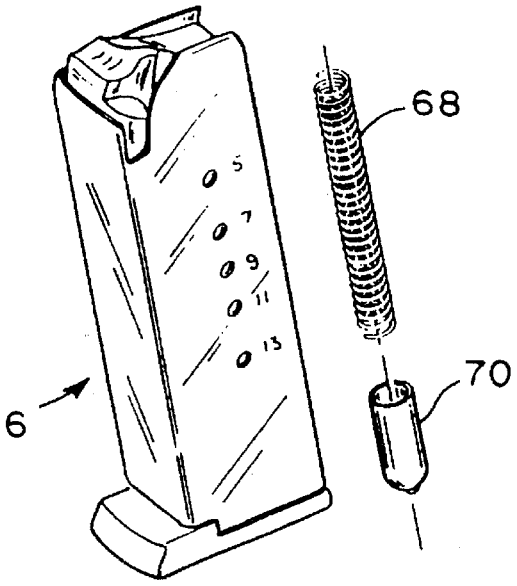

As shown in FIGS. 1–1B, barrel/receiver assembly 8 includes a barrel housing 60 mounted to case 18, using an assembly pin 61, and housing a barrel 62. Assembly 8 also includes a recoil spring 64 extending over a recoil bar 66. These are all conventional components. The conventional components of handgun 2 also include a main spring 68, used to bias hammer 16 in the direction of arrow 22. Main spring is part of stirrup spring assembly 24. The base of main spring 68 is housed within a spring housing 70 within handle 10. Handle 10 includes a handgrip 72 which fits over the handle portion 74 of case 18. Finally, a hammer pin 76 is mounted to case 18 about which hammer 16 pivots. Handgrip 72 is secured to handle portion 74 of case 18 by a mounting pin 78.

The remaining components shown in FIG. 1 are part of the modification of the conventional components shown in the figures. These components are collectively referred to as the firing mechanism disabling components 80. Components 80 include an actuation bar 82 pivotally mounted to the butt end 84 of handle portion 74 of case 18 by a pivot pin 86. The upper end 88 of actuation bar 82 has a through hole 90 formed through it. One end of through hole 90 accepts the shorter end 92 of a wire form 94. Wire form 94 is housed within case 18 and has a longer end 96 which is positioned above hammer draw bar 20 as shown best in FIGS. 3A–3C. Wire form 94 is also shown in dashed lines in FIG. 2.

The other end of hole 90 is engaged by the bent end 98 of an interlock block 100. Interlock block 100 has straight sections 102, 104 that fit within slots 106, 108 formed in handle portion 74 of case 18. This arrangement permits interlock block 100 to move in forward or proximal and rearward or distal directions, thus pivoting actuation bar 82 about pivot pin 86 as it does so. Interlock block 100 includes a blind bore, not shown, at its lower edge, see FIG. 2, into which the upper end 110 of a spring wire 112 is mounted. The lower end 114 of spring wire 112 is housed within an angled slot 116 formed in handle portion 74 adjacent butt end 84. Spring wire 112 is held in place by the head of a screw 118 which engages a threaded hole 120 formed in handle portion 74 adjacent angled slot 116. Spring wire 112 is sized and positioned so to bias actuation bar 82 in distal direction 50. Doing so pulls longer end 96 of wire form 94 downwardly, that is in the direction of arrow 58 of FIG. 3C, thus disabling handgun 2 by causing proximal end 40 of draw bar 20 to disengage from notched engagement surface 42 of hammer 16 as shown in FIG. 3C.

Firing mechanism disabling components 80 also include an interlock slide 122 shaped like an inverted T. Interlock slide 122 has a main shank 124 which slides within a shallow cut-out 126 formed in case 18. A generally U-shaped spring 128 is used to bias interlock slide 122 downwardly, that is towards interlock block 100. The upper leg 130 of spring 128 is captured within a spring slot 132 formed in case 18 while the lower leg 134 of spring 128 engages a laterally extending boss 136, positioned near the upper end of shank 124. The lower end 138 of interlock slide 122 is sized to engage a complementary recess 140 formed in interlock block 100.

Boss 136 extends through a slot 142 formed in handgrip 72. A button or switch 144 is mounted to boss 136 by a screw 145. Switch 144 can be moved from the lowered or first position of FIG. 2 by the user pressing, typically with his or thumb, upwardly in the direction of arrow 146 to permit the removal of lower end 138 of interlock slide 122 from recess 140 of interlock block 100. Doing so permits the user to rotate actuation bar 82 by pressing on bar 82 in proximal direction 44. Prior to raising switch 144, engagement of end 138 within recess 140 prevents pivotal movement of actuation bar 82 in proximal direction 44, thus maintaining handgun 2 in a deactuated or safe condition. After moving switch 144 from the first position of FIG. 2 upwardly to a second position, actuation bar 82 can then be pivoted proximally or rearwardly in the direction of arrow 44, thus moving longer end 96 of wire form 94 upwardly in the general direction of arrow 146, thus permitting the engagement of proximal end 40 of draw bar 20 with surface 42 of hammer 16. In this position, pulling on trigger 14 causes hammer 16 to pivot in the direction of arrow 52 to compress main spring 68 so that, at the end of the travel of trigger 14, proximal end 40 of draw bar 20 disengages from surface 42, as is conventional, allowing hammer 16 to pivot back in the direction of arrow 22 to fire the weapon.

In use, the magazine 6 is loaded with rounds of ammunition in a conventional manner and then inserted through an opening 148 in butt end 84 of handle portion 74 of case 18. A round can be chambered into barrel 62 by pulling barrel housing 60 in a rearward or proximal direction 44 and then returning barrel 60 back to its distal or forward position. Doing so also cocks hammer 16 to the position of FIG. 3B. If handgun 2 is not to be fired at that time, hammer 16 is pulled back slightly, trigger 14 is pulled and the hammer is allowed to slowly return to the position of FIGS. 2 and 3A so as not to cause a discharge of the weapon.

Assuming handgun 2 is in user's holster, switch 144 and actuation bar 82, which acts as a second switch, assume their positions of FIG. 2 naturally by virtue of spring wire 112 biasing interlock block 100 in proximal direction 44 causing interlock slide 122 to ride over the upper edge of interlock block 100 until lower end 138 engages recess 140.

In the condition of FIGS. 2 and 3C, handgun 2 is in a safe condition so that pulling on trigger 14 will not cause the weapon to discharge. If the need arises to draw the weapon from the holster, shown schematically in phantom in FIG. 2 as 150, the officer can arm handgun 2 during this process. Grasping handle 10, the officer presses on first switch 144 in the direction of arrow 146 with the officer's thumb while grasping handle 10. Once lower end 138 has cleared recess 140, the user's fingers grasping handle 10 causes actuation bar 82 to be pivoted in the direction of arrow 44, thus raising longer end 96 of wire form 94. This permits draw bar spring 38 to pivot draw bar 20 in the direction of arrow 36 so that end 40 and surface 42 become engaged, as shown in FIG. 3A. Handgun 2 is now enabled so that pulling on trigger 14 in the direction of arrow 44 will cause the rotation of hammer 16 in the direction of arrow 52 until, at the final movement of the trigger, the hammer is released, allowing main spring 68 to drive the hammer in the direction of arrow 22 and thus discharge the weapon.

The purpose of the invention is to help protect the officer or other user of the weapon in the event that, after the weapon has been withdrawn from, for example, the holster, release of the weapon, thus releasing switch 144 and actuation bar 82, causes firing mechanism disabling components 80 to reassume the safe or disabled position of FIG. 2. This creates two problems for a criminal who happens to pick up the weapon. First, the criminal must be familiar with the disabling system to know what to do to enable or rearm the weapon. Second, the position of switch 144, coupled with the strength of spring 128, generally requires the user to brace barrel/receiver assembly 8 against user's other hand to allow switch 144 to be manipulated. This is not necessary while handgun 2 is housed within holster 148, since a force exerted by the user's thumb against first switch 144 is resisted by holster 148 to permit one-handed arming of handgun 2. Spring 128 preferably applies a sufficient force to boss 136 to require the user to apply a force of about 3 to 6 pounds (1.3 to 2.7 kg), and preferably about 4 pounds (1.8 kg), to switch 144 to compress spring 128 sufficiently to allow lower end 138 to be removed from recess 140.

Figure 5:
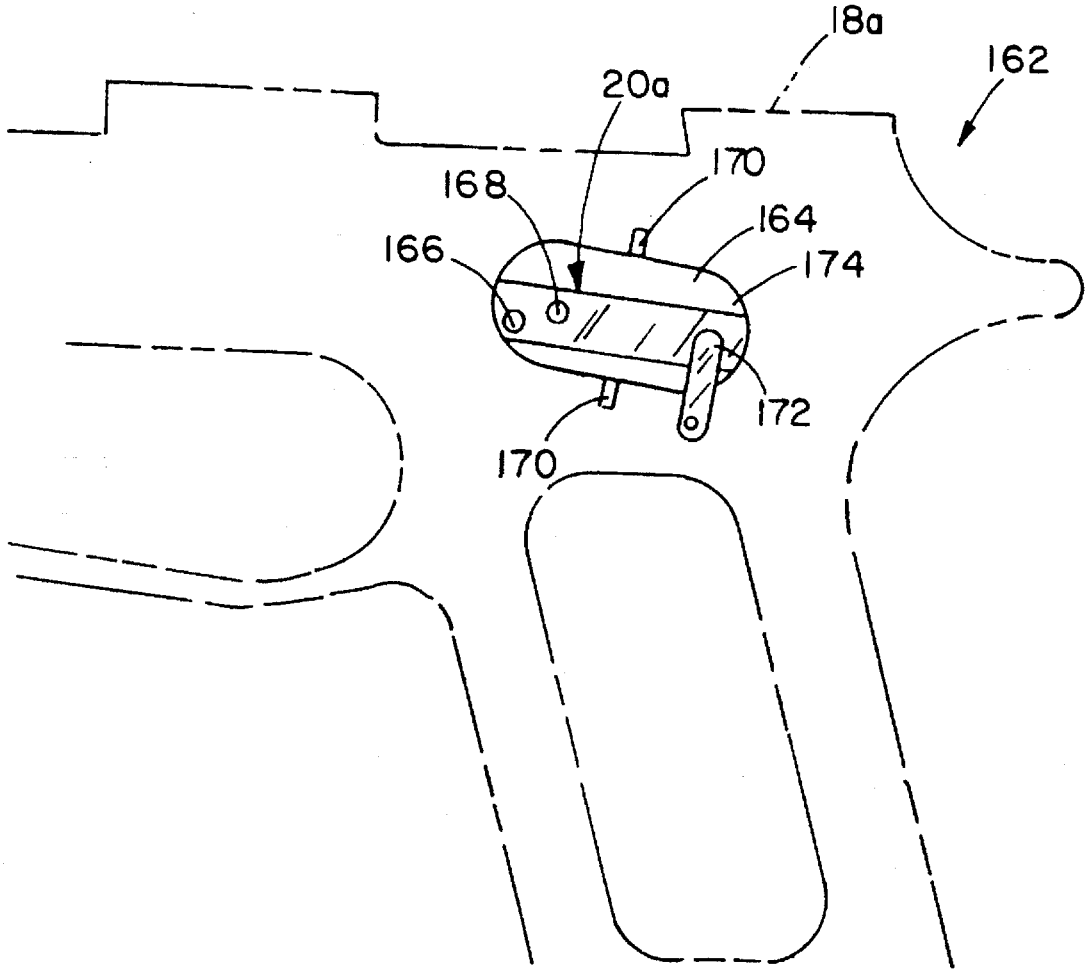
FIG. 5 is a simplified side view of a handgun modified according to a second embodiment of the invention with the switch element of FIGS. 6A and 6B not shown.
Figure 6A:
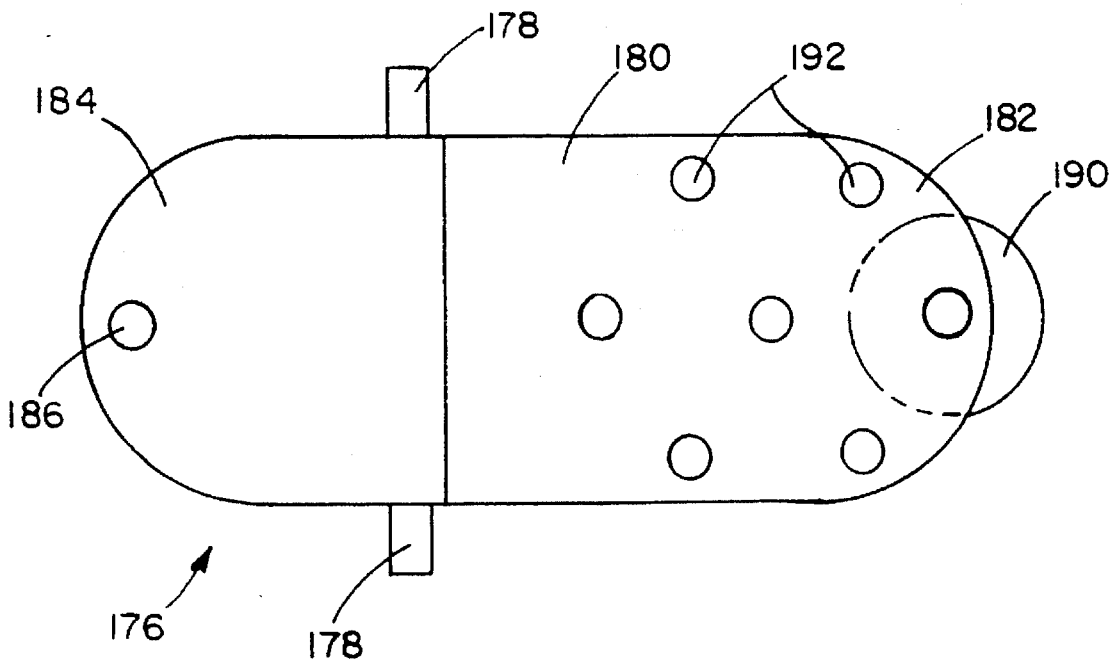
FIG. 6A is a top view and FIG. 6B is a side cross-sectional view of a switch element used with the weapon of FIG. 5.
Figure 6B:
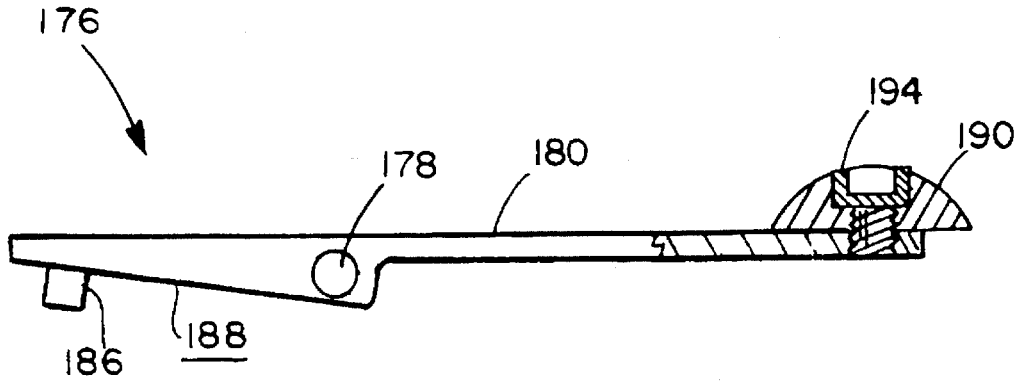
Figure 7:
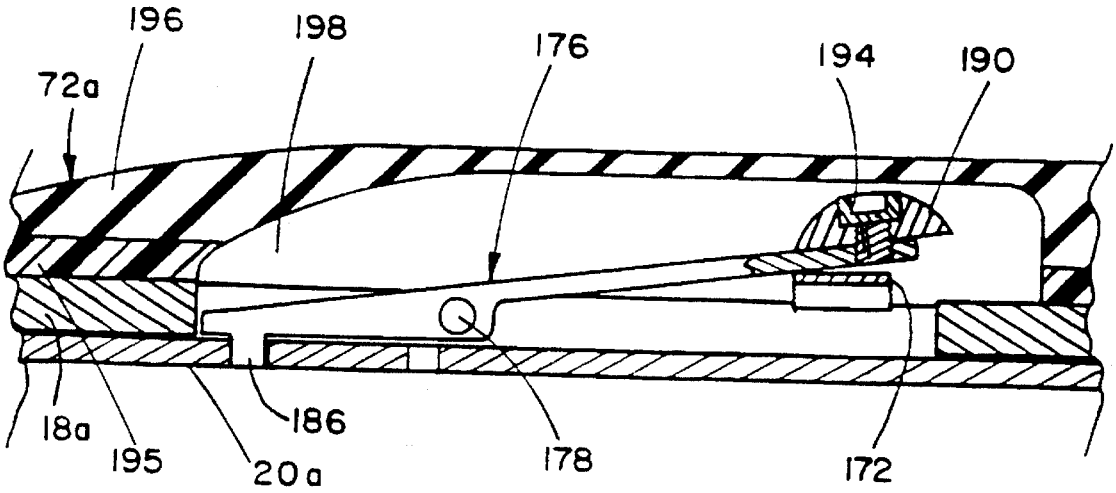
FIG. 7 is a cross-sectional view of the firing mechanism disabling components of FIGS. 5–6B.

FIGS. 5–7 illustrate a second embodiment of the invention in which firing mechanisms disabling components 160 are used to modify a conventional Smith & Wesson 9 mm Model 5904 pistol as discussed above with reference to FIGS. 1–5. Accordingly, the main components of handgun 162, other than components 160, will not be described in detail. Components 160 include a switch assembly 163 (see FIG. 7) mounted to case **18*a* at oval opening 164 formed in case 18*a*. Oval opening 164 is positioned adjacent draw bar 20*a*, draw bar 20*a* having a pair of holes 166, 168 formed therein. Case 18*a* also has a pair of pivot slots 170 formed on opposite sides of opening 164. A flat spring 172 is mounted to case 18*a* adjacent the proximal end 174 of oval opening 164**.

A switch element 176 is mounted to overlie oval opening 164 by a pair of pivot axles 178 extending laterally from an oval base 180, axles 178 being secured within pivot slots 170. The proximal end 182 of base 180 overlies flat spring 172 and is engaged by spring 172 to pivot switch element 176 about pivot axles 178. The distal end 184 of base 180 has an interlock pin 186 extending from its interior surface 188. Pin 186 is sized and positioned to engage hole 166, under the bias of spring 172, when hammer 16 is fully forward and trigger 14 is fully forward as shown in FIG. 3A. This is a first stable position of hammer draw bar **20*a*. Hole 168 is positioned to be engaged by interlock pin 186 when draw bar 20 is in its second stable position, that is with hammer 16 partially pulled back and trigger 14 partially pulled back as illustrated in FIG. 3B. This condition commonly occurs after a round has been fired. Thus, under the bias of spring 172, interlock pin 186 normally engages either of holes 166, 168. When so engaged, bar 20***a* is effectively kept from moving thus disabling handgun 162.

An arming switch or button 190 is mounted to one of seven threaded holes 192 at proximal end 182 of base 180 using a screw 194. Hand grip 72*a* includes a stiff plastic base portion 195 over which an elastomeric layer 196 is formed. Base portion 195 has an opening 198 positioned to overlie switch 190 regardless of which hole 192 switch 190 is mounted to. Switch 190 could be constructed to raise the surface of elastomeric layer 196 very slightly to provide the owner an indication of the precise location of switch 190. As is evident from the different locations of holes 192, the location of arming switch 190 can be modified to accommodate the owner of the weapon. However, since the elastomeric layer 196 covers switch 190, the existence of switch 190 and the need to press switch 190 to disengage interlock pin 186 from either of holes 166, 168 will not be apparent to the casual user. However, regardless of the position of draw bar 20*a*, upon the release of switch 190, which can occur when an officer drops the weapon, spring 172 automatically pivots interlock pin 186 into engagement with one of holes 166, 168 to prevent movement of draw bar 20*a* thus disabling handgun 162.

Modification and variation can be made to the disclosed embodiments without departing from the subject of the invention as defined in the following claims. For example, the invention could be utilized with other semi-automatic pistols, automatic pistols, and revolvers as well as other firearms, such as rifles and shotguns. Other types and locations of one or more switches could be used. The invention could also be used with firearms of the type which do not use hammers to drive the firing pins, such as the type in which a spring-loaded firing pin is released by pulling the trigger. The invention could also take the place of the conventional safety or, as in the preferred embodiments, be used in conjunction with the conventional safety 54.

What is claimed is:

1. An improved automatically disabled handgun of the type having a body, the body including a handle assembly having an upper end extending from a barrel/receiver assembly, the handgun carried in a holster, the improvement comprising:

a first user actuatable switch mounted adjacent the upper end of the handle assembly and movable from a first position to a second position;

means for biasing the first switch towards the first position;

a second user actuatable switch mounted to the body and movable between a disable position and an enable position;

means for biasing the second switch towards the disable position;

means, coupled to the second switch, for preventing firing of the handgun when the second switch is in the disable position; and means for preventing movement of the second switch to the enable position unless the first switch is in the second position;

whereby release of the first and second switches permits the switches to be biased to the first position and to the disabled position so to disable the handgun.

2. The improved handgun of claim 1 further comprising use means for increasing the difficulty of one-handed actuation of the first and the second switches when the handgun is withdrawn from the holster while reducing the difficulty of one-handed actuation of the first and the second switches when the handgun is in the holster.

3. The improved handgun of claim 1 wherein the second switch is mounted to the handle assembly and is positioned to be engageable by at least one of the user's fingers.

4. The improved handgun of claim 3 wherein the handle assembly has a forward region and the second switch is pivotally mounted to the forward region to be engageable by a plurality of the user's fingers.

5. An improved automatically disabled handgun of the type having a body, the body including a handle assembly having an upper end extending from a barrel/receiver assembly, the handgun carried in a holster, the improvement comprising:

a first switch mounted adjacent the upper end of the handle assembly and movable from a first position to a second position;

means for biasing the first switch towards the first position;

a second switch mounted to the body and movable between a disable position and an enable position;

means for biasing the second switch towards the disable position;

means, coupled to the second switch, for preventing firing of the handgun when the second switch is in the disable position; and means for preventing movement of the second switch to the enable position unless the first switch is in the second position, the first switch being positioned and the first switch biasing means being adapted so that the first switch is engaged by the user's thumb exerting a switch force in a direction from the handle towards the barrel/receiver assembly, said switch force being counteracted by the handgun pressing against the holster;

whereby release of the first and second switches permits the switches to be biased to the first position and to the disabled position so to disable the handgun.

6. The improved handgun of claim 5 wherein the switch force is about 3 to 6 pounds.

7. An improved automatically disabled handgun of the type having a body, the body including a handle assembly having an upper end extending from a barrel/receiver assembly, the handgun carried in a holster, the improvement comprising:

a first switch mounted to the body and movable from a first position to a second position;

means for biasing the first switch towards the first position;

a second switch mounted to the body and movable between a disable position and an enable position;

means for biasing the second switch towards the disable position;

means, coupled to the second switch, for preventing firing of the handgun when the second switch is in the disable position;

means for preventing movement of the second switch to the enable position unless the first switch is in the second position; and means for positioning the first switch at a location which requires the user to push on the first switch in a direction from the handle assembly towards the barrel/receiver assembly;

whereby release of the first and second switches permits the switches to be biased to the first position and to the disabled position so to disable the handgun.

8. The improved handgun of claim 7 wherein the use means includes means for creating a force on the first switch so that the user must exert a switch force of between about 3 to 6 pounds on the first switch to overcome the bias force of the first biasing means to move the first switch from first position to the second position, said switch force being counteracted by the handgun pressing against the holster.

9. The improved handgun of claim 8 wherein the first biasing means exerts a force on the first switch approximately equal to the switch force.

10. An improved combination of an automatically disabled pistol and a holster, the pistol being of the type including a body and a magazine for holding shells, the body including a barrel/receiver assembly and a handle assembly extending from the barrel/receiver assembly, the handle assembly having a magazine cavity defined therein and butt end having an access opening through which the magazine is inserted into and removed from the magazine cavity, the barrel/receiver assembly including a trigger operably coupled to a hammer assembly by a coupling element actuator so that upon pulling the trigger, the hammer assembly drives the hammer from a cocked position to a discharge position thus firing the pistol, the pistol carried in the holster, the improvement comprising:

a first switch mounted to the body and movable from a first position to a second position;

means for biasing the first switch towards the first position;

a second switch mounted to the body and movable between a disable position and an enable position;

means for biasing the second switch towards the disable position;

means, coupled to the second switch, for preventing firing of the pistol when the second switch is in the disable position;

means for preventing movement of the second switch to the enable position unless the first switch is in the second position; and the first switch being positioned and the first biasing means being adapted so that the first switch can be moved into the second position by the user's hand exerting a switch force on the first switch when the user's hand is wrapped around the handle assembly, the switch force being applied in a direction such that said force is counteracted by the pistol pressing against the holster;

whereby release of the first and second switches permits the switches to be biased to the first position and the disabled position so to disable the pistol.

11. The improved pistol of claim 10 wherein the first switch is positioned in a region adjacent an intersection of the barrel/receiver assembly and the handle assembly so that the user pushes on the first switch with the user's thumb with a switch force of about 3 to 6 pounds in a direction extending from the butt end of the handle assembly towards the barrel/receiver assembly, the switch force being counteracted by the pistol pressing against the holster when the pistol is carried within the holster.

12. The improved pistol of claim 10 wherein the firing preventing means includes a wire form connecting the second switch and the coupling element actuator at least when the second switch is in the disable position.

13. The improved pistol of claim 10 wherein the second switch is mounted to the handle assembly and is positioned to be engageable by at least one of the user's fingers.

* * * * *